US008144914B2

(12) United States Patent
Shi

(10) Patent No.: US 8,144,914 B2
(45) Date of Patent: Mar. 27, 2012

(54) WIRELESS EARPHONE AND PORTABLE ELECTRONIC DEVICE USING THE SAME

(75) Inventor: Zheng Shi, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 403 days.

(21) Appl. No.: 12/487,736

(22) Filed: Jun. 19, 2009

(65) Prior Publication Data

US 2009/0323999 A1 Dec. 31, 2009

(30) Foreign Application Priority Data

Jun. 27, 2008 (CN) ..... 2008 1 0302391

(51) Int. Cl.
*H04R 25/00* (2006.01)

(52) U.S. Cl. ..... 381/375; 381/370; 381/374; 455/569.1

(58) Field of Classification Search ..... 381/370, 381/374, 375, 376, 381; 379/430, 420.01, 379/428.01, 428.02, 433.01, 431; 455/41.2, 455/569.1, 575.1, 575.2, 575.6
See application file for complete search history.

(56) References Cited

U.S. PATENT DOCUMENTS 7,120,476 B2 * 10/2006 Yoo ..... 455/575.1
2005/0107131 A1 * 5/2005 Abramov ..... 455/569.1
* cited by examiner

*Primary Examiner* — Huyen D Le
(74) *Attorney, Agent, or Firm* — Altis Law Group, Inc.

(57) ABSTRACT

A wireless earphone includes a first answering member and a hanging member. The first answering member includes a base, a microphone and a head phones device. The first answering member is disposed at one end of the hanging member and is configured for being detachably mounted on a portable electronic device. The microphone is disposed at the distal end of the first base. The earphone is disposed at the other end of the first base adjacent to the hanging member. The invention also includes a portable electronic device using the wireless earphone.

20 Claims, 4 Drawing Sheets

WIRELESS EARPHONE AND PORTABLE ELECTRONIC DEVICE USING THE SAME

CROSS-REFERENCE TO RELATED APPLICATIONS

This application is related to co-pending U.S. patent application Ser. No. 12/487,738, entitled "WIRELESS EARPHONE AND PORTABLE ELECTRONIC DEVICE USING THE SAME". Such application has the same assignee as the present application. The above-identified application is incorporated herein by reference.

BACKGROUND

1. Technical Field

The exemplary disclosure generally relates to a wireless earphone and a portable electronic device with the wireless earphone.

2. Description of Related Art

With the development of wireless communication and information processing technologies, portable electronic devices such as mobile phones and personal digital assistants (PDAs) are now in widespread use, and consumers may now enjoy the full convenience of high technology products almost anytime and anywhere. Wireless earphone such as based on BLUETOOTH technology are widely used with these portable electronic devices facilitating convenient hands free communication.

However, the conventional wireless earphone is usually a separate component from the portable electronic devices such as mobile phone, personal digital assistant and etc. Therefore, the wireless earphone may not be carried at all time with the portable electronic device. Because of the small volume of the wireless earphone, the wireless earphone may easily be lost.

When using the wireless earphone, it is often hung on the user's ear, after long time using the wireless earphone, it may cause discomfort to the users.

Therefore, there is room for improvement within the art.

BRIEF DESCRIPTION OF THE DRAWINGS

Many aspects of the wireless earphone and portable electronic device with the wireless earphone be better understood with reference to the following drawings. These drawings are not necessarily drawn to scale, the emphasis instead being placed upon clearly illustrating the principles of the present wireless earphone and portable electronic device with the wireless earphone. Moreover, in the drawings like reference numerals designate corresponding sections throughout the several views.

DETAILED DESCRIPTION

Figure 1:
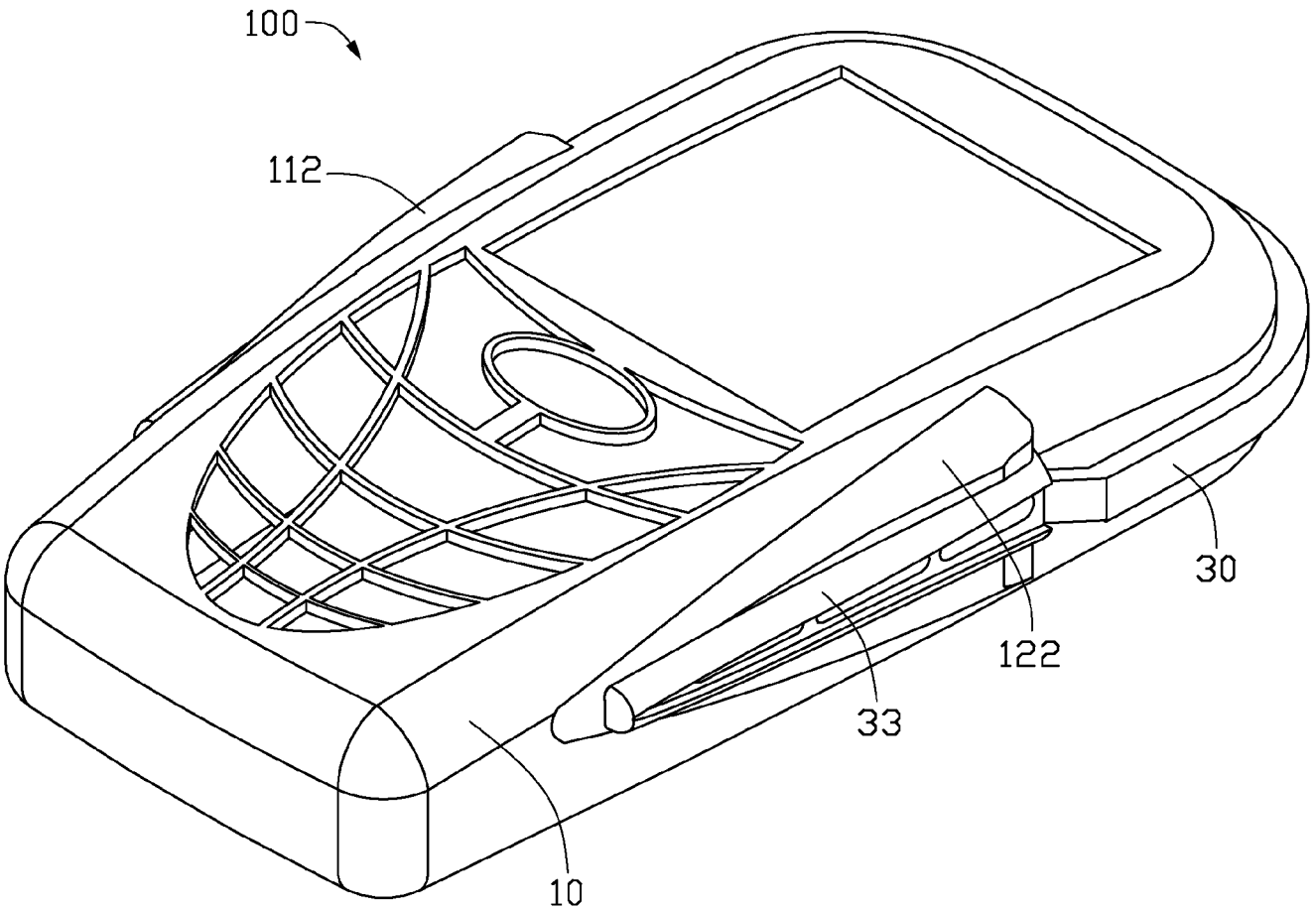
FIG. 1 shows a perspective view of a portable electronic device with wireless earphone mounted thereon, in accordance with an exemplary embodiment of the present invention.
Figure 2:
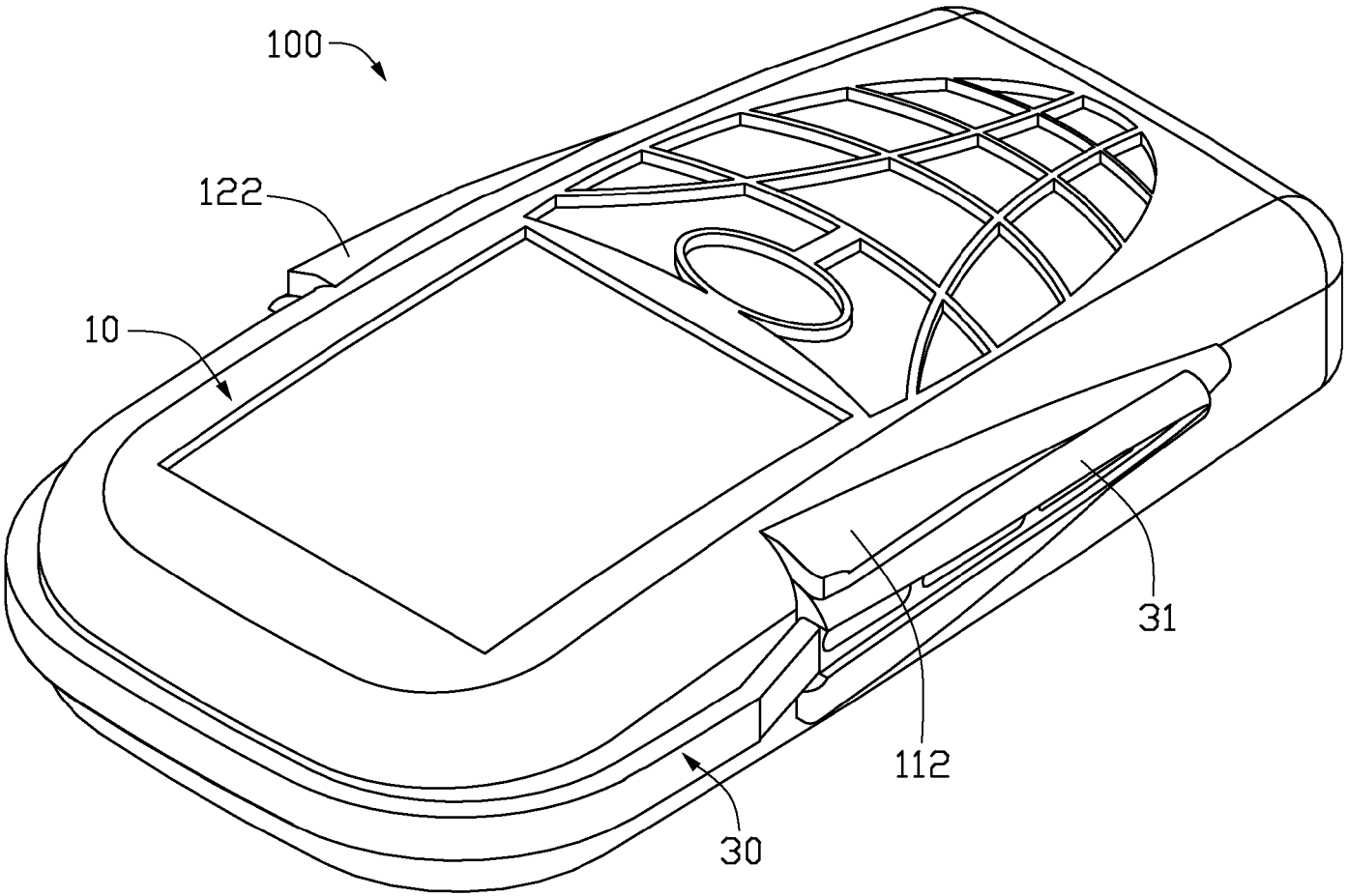
FIG. 2 is similar to FIG. 1, but viewed from another aspect.

FIG. 1 and FIG. 2 show an exemplary portable electronic devices, such as mobile phone terminals, personal digital assistant and etc, with wireless earphone such as based on BLUETOOTH technology. The portable electronic device 100 includes a body 10 and a wireless earphone 30 detachably assembled with or mounted on the body 10.

Figure 3:
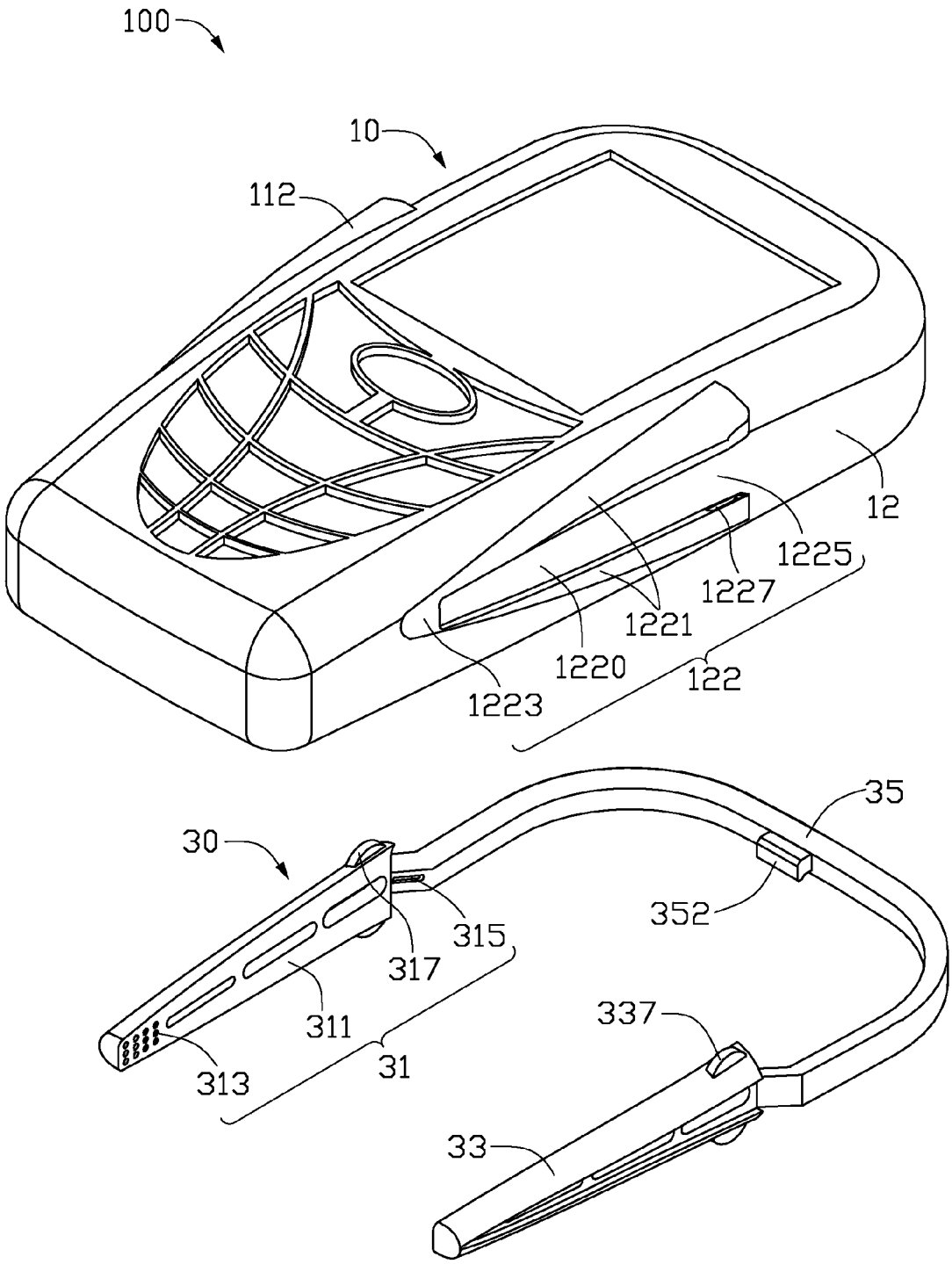
FIG. 3 shows a perspective view of the portable electronic device with the wireless earphone detached apart therefrom, in accordance with an exemplary embodiment of the present invention shown in FIG. 1.
Figure 4:
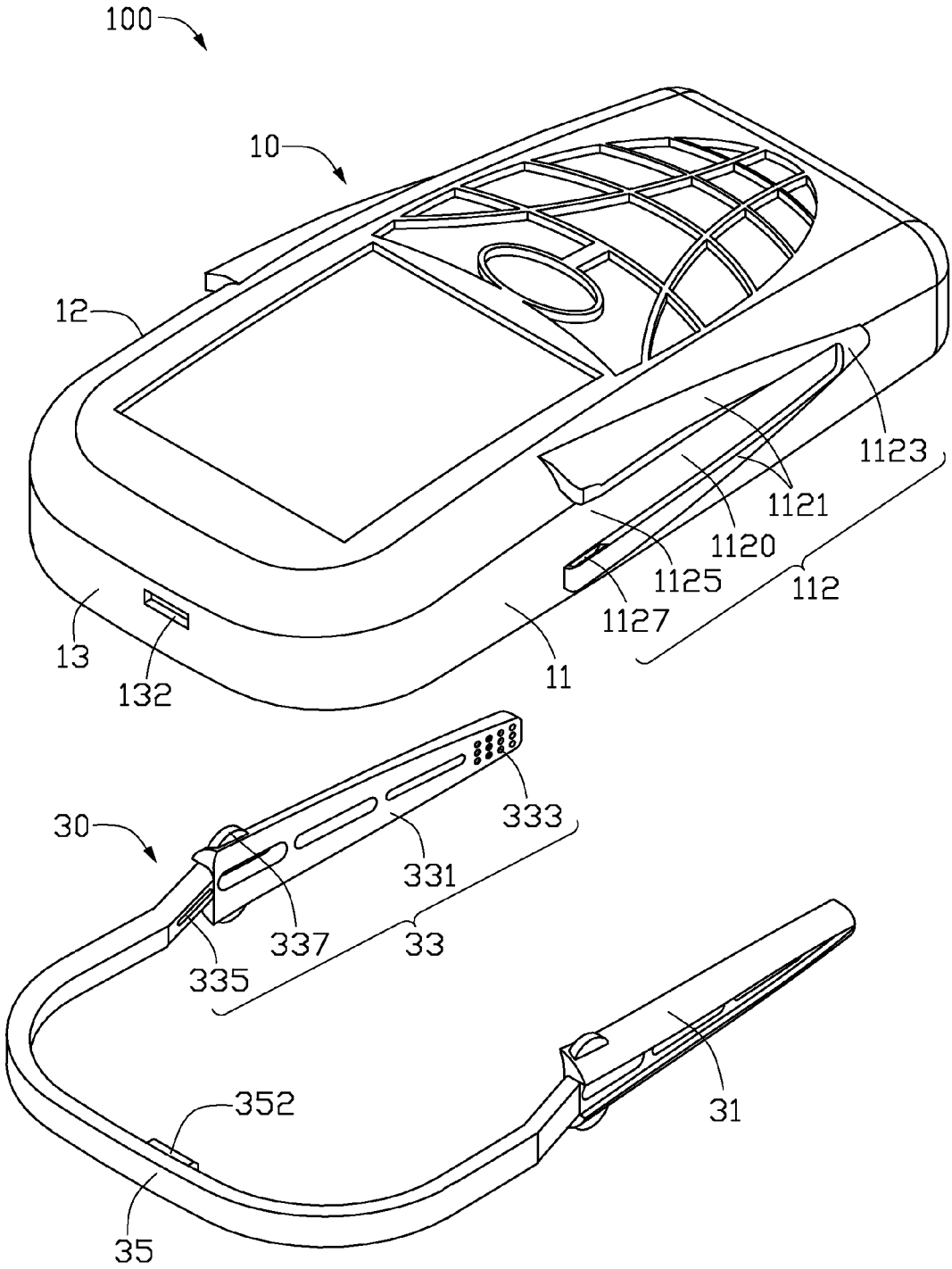
FIG. 4 shows a perspective view of the portable electronic device with the wireless earphone detached apart therefrom, in accordance with an exemplary embodiment of the present invention shown in FIG. 2.

Referring to FIG. 3 and FIG. 4, the body 10 may be a mobile phone or a personal digital assistant. The body 10 includes a first sidewall 11, a second sidewall 12 and a third sidewall 13. The first sidewall 11 and the second sidewall 12 are symmetrically disposed at two opposite sides of the body 10. The third sidewall 13 is substantially perpendicular to the first sidewall 11 and the second wall 12. The body 10 includes a first accommodating portion 112 disposed at the substantially middle portion of the first sidewall 11. The first accommodating portion 112 is substantially V-shaped and includes two accommodating walls 1121 protruding from the first sidewall 11 longitudinally. One end of the two accommodating walls 1121 joint together and thus forms a closed end 1123, the other end of the two accommodating walls 1121 spaced apart extend toward the third sidewall 13 and thus forms an opening end 1125 therebetween. The two accommodating walls 1121 and the first sidewall 11 form the V-shaped accommodating space 1120 together, so as to accommodate one end of the wireless earphone 30. The two accommodating walls 1121 both has a latching groove 1127 recessed thereon adjacent to the opening end 1125 facing to each other.

The body 10 further includes a second accommodating portion 122 disposed at the substantially middle portion of the second sidewall 12. The second accommodating portion 122 is substantially V-shaped protruding longitudinally from the second sidewall 12. The second accommodating portion 122 includes two accommodating walls 1221, one end of the two accommodating walls 1221 joint together and thus forms a closed end 1223, the other end of the two accommodating walls 1221 spaced apart extend toward the third sidewall 13 and thus forms an opening end 1225. The two accommodating walls 1221 and the second sidewall 12 form the V-shaped accommodating space 1220 together, so as to accommodate the other end of the wireless earphone 30. The two accommodating walls 1221 both has a latching groove 1227 recessed thereon adjacent to the opening end 1225 opposite to each other. The third sidewall 13 has a latching slot 132 recessed from the substantially middle portion thereof.

The wireless earphone 30 is substantially U-shaped and made of flexible elastic material. When to be worn on the head of the user, the wireless earphone 30 may be bent and flexed to adjust the relative distance or angle between the two ends thereof. The wireless earphone 30 includes a first answering member 31, an opposite second answering member 33 and a hanging member 35. The first answering member 31 and the second answering member 33 are disposed at the two ends of the hanging member 35. The first answering member 31 includes a first base 311, a microphone 313 and an earphone 315. The first base 311 is a substantially V-shaped block corresponding to the accommodating space 1120 of the body 10. The first base 311 connects with the one end of the hanging member 35. The microphone 313 is disposed at the distal end of the first base 311 far away from the hanging member 35. The earphone 315 is disposed at the opposite end thereof near the end of the hanging member 35. The first base 311 includes two latching portions 317 disposed at the two opposite sides thereof adjacent to the earphone 315 and correspond to the two latching groove 1127 of the two accommodating walls 1121. In the present embodiment, the two latching portions 317 are substantially arc-shaped block protruding from the two sides of the first base 311 and are made of elastic material.

The second answering member 33 has the same structure and shape with the first answering member 31 and is symmetrically disposed at the other end of the hanging member 35. The second answering member 33 includes a second base 331, a microphone 333 and an earphone 335. The second base 331 is a substantially V-shaped block corresponding to the accommodating space 1220 of the body 10. The second base 331 connects with the other end of the hanging member 35. The microphone 313 is disposed at the distal end of the second base 331 far away from the hanging member 35; the earphone 335 is disposed at the opposite end thereof connecting with the other end of the hanging member 35. The second base 331 includes two latching portions 337 disposed at the two opposite sides thereof adjacent to the earphone 335 end, corresponding to the two latching groove 1227 of the two accommodating walls 1221. In the present embodiment, the two latching portions 337 are substantially arc-shaped block protruding from the two sides of the second base 331 and are made of elastic material.

The hanging member 35 is a substantially U-shaped flexural strip and is made of flexible or elastic material. The hanging member 35 may be bent to adjust the distance and the angle between the two ends thereof, so as to wear the wireless earphone 30 on the head of the user properly or comfortably. The hanging member 35 includes a block 352 disposed at the substantially middle portion of the inner surface thereof, corresponding to the latching slot 132 of the body 10.

When the wireless earphone 30 is not in use, the wireless earphone 30 is detachably mounted on the body 10. The first answering member 31 and the second answering member 33 are assembled within the corresponding first accommodating portion 112 and the second accommodating portion 122 of the body 10 respectively. The latching portions 317 of the first answering member 31 and the latching portions 337 of the second answering member 33 latch with the corresponding latching grooves 1127 and 1227 respectively. The inner surface (not labeled) of the hanging member 35 tightly resists on the first sidewall 11, the second sidewall 12 and the third sidewall 13, and the block 352 latches with the latching slot 132 of the third sidewall 13.

When using the wireless earphone 30, the wireless earphone 30 is detached from the body 10, the hanging member 35 is bent to adjust the distance and the angle between the first answering member 31 and the second answering member 33 so as to be worn on the on the head. The microphone 313(333) and the earphone 315(335) are located adjacent to the mouth and the ear of the user respectively.

It is to be understood that the wireless earphone 30 is not just limited to the U-shaped structure, the wireless earphone 30 could be only make up of a first answering member 31 and a hanging porting 35, the second answering member 33 may be omitted. In usage, the hanging member 35 is entangled in one ear or the neck of the user, the first answering member is adjusted to be located adjacent the mouth and the ear of the user.

It is to be understood that the first accommodating portion 112 and the second accommodating portion 122 may be a groove or slot recessed on the first sidewall 11 and the second sidewall 12.

It is to be understood that the hanging member 31 and the answering members of the wireless earphone 30 may be produce by one-mold molding method with plastic material, such as polyvinylchloride (PVC) resin, polypropylene resin, polyethylene resin, polyethylene terephthalate (PET) resin, polycarbonate (PC), nylon resin, polyvinyl formal resin, alkyd resin, polyimide resin and etc.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of sections within the principles of the invention to the full extent indicated by the broad general meaning of the terms, in which the appended claims are expressed.

What is claimed is:

1. A wireless earphone capable of being used in a portable electronic device, the wireless earphone comprising:
- a hanging member made of flexible or elastic material; and
- a first answering member disposed at one end of the hanging member, comprising:
  - a first base comprising a latching portion disposed thereon and configured for being detachably mounted on the portable electronic device;
  - a microphone disposed at the distal end of the first base; and
  - an earphone disposed at the other end of the first base adjacent to the hanging member.

2. The wireless earphone as claimed in claim 1, wherein the hanging member includes a block disposed at the inner surface thereof and configured for being detachably mounted on the portable electronic device.

3. The wireless earphone as claimed in claim 2, wherein the wireless earphone further includes a second answering member disposed at the other end of the hanging member, the second answering member includes a second base with a latching portion disposed thereon, a microphone disposed at the distal end of the second base and an earphone disposed at the other end of the second base adjacent to the other end of the hanging member.

4. The wireless earphone as claimed in claim 3, wherein the second base further includes a latching portion disposed thereon and configured for being detachably mounted on the portable electronic device.

5. The wireless earphone as claimed in claim 4, wherein the wireless earphone is substantially U-shaped and may be bent and flexed to adjust the relative distance or angle between the two ends thereof.

6. The wireless earphone as claimed in claim 5, wherein the wireless earphone may be produced by one-mold molding method with polyvinylchloride resin, polypropylene resin, polyethylene resin, polyethylene resin, polycarbonate, nylon resin, polyvinyl formal resin, alkyd resin or polyimide resin.

7. The wireless earphone in claim 4, wherein the first base and the second base both are substantially V-shaped blocks.

8. A portable electronic device, comprising:
- a body comprising a first sidewall and a first accommodating portion disposed at the first sidewall;
- a wireless earphone detachably mounted on the body, the wireless earphone comprising:
  - a hanging member made of flexible or elastic material; and
  - a first answering member disposed at one end of the hanging member and accommodated within the first accommodating portion, comprising:
    - a first base;
    - a microphone disposed at the distal end of the first base; and
    - an earphone disposed at the other end of the first base adjacent to the hanging member.

9. The portable electronic device as claimed in claim 8, wherein the body includes a first sidewall, the first accommodating portion is substantially V-shaped disposed on the first sidewall longitudinally.

10. The portable electronic device as claimed in claim 9, wherein the first accommodating portion includes two accommodating walls, one end of the two accommodating walls joint together and thus forms a closed end; the other end of the two accommodating walls spaced apart extend toward the third sidewall and thus forms an opening end; the two accommodating walls and the first sidewall form a V-shaped accommodating space together to accommodate the first answering member.

11. The portable electronic device as claimed in claim 10, wherein the two accommodating walls both has a latching groove recessed therefrom facing to each other; the base includes two latching portions disposed at the two opposite sides thereof for latching with the corresponding two latching groove of the two accommodating walls.

12. The portable electronic device as claimed in claim 11, wherein the body further includes a second sidewall parallel to the first sidewall and a third sidewall perpendicular to the first sidewall and the second sidewall; the third sidewall has a latching slot recessed therefrom, the hanging member includes a block disposed at the inner surface thereof corresponding to the latching slot of the body; the block latches into the latching slot.

13. The portable electronic device as claimed in claim 12, wherein the wireless earphone further includes a second answering member disposed at the other end of the hanging member, the second sidewall includes second accommodating portion disposed thereon corresponding to the second answering member; the second answering member is detachably assembled within the second accommodating portion.

14. The portable electronic device as claimed in claim 13, wherein the wireless earphone is substantially U-shaped and may be bent and flexed to adjust the relative distance or angle between the two ends thereof.

15. The portable electronic device as claimed in claim 8, wherein the first accommodating portion is a groove or slot recessed from the first sidewall.

16. A portable electronic device, comprising:

a body comprising a first sidewall and a first accommodating portion disposed at the first sidewall.

a wireless earphone detachably mounted on the body, the wireless earphone comprising:

a hanging member made of flexible or elastic material; and a first answering member disposed at one end of the hanging member and accommodated within the first accommodating portion, comprising:

a first base;

a microphone disposed at the distal end of the first base; and an earphone disposed at the other end of the first base adjacent to the hanging member;

wherein the wireless earphone further includes a second answering member disposed at the other end of the hanging member, the second answering member includes a second base with a latching portion disposed thereon, a microphone disposed at the distal end of the second base and an earphone disposed at the other end of the second base adjacent to the other end of the hanging member.

17. The portable electronic device as claimed in claim 16, wherein the body includes a first sidewall, the first accommodating portion is substantially V-shaped disposed on the first sidewall longitudinally.

18. The portable electronic device as claimed in claim 17, wherein the first accommodating portion includes two accommodating walls, one end of the two accommodating walls joint together and thus forms a closed end; the other end of the two accommodating walls spaced apart extend toward the third sidewall and thus forms an opening end; the two accommodating walls and the first sidewall form a V-shaped accommodating space together to accommodate the first answering member.

19. The portable electronic device as claimed in claim 18, wherein the two accommodating walls both has a latching groove recessed therefrom facing to each other; the base includes two latching portions disposed at the two opposite sides thereof for latching with the corresponding two latching groove of the two accommodating walls.

20. The portable electronic device as claimed in claim 19, wherein the body further includes a second sidewall parallel to the first sidewall and a third sidewall perpendicular to the first sidewall and the second sidewall; the third sidewall has a latching slot recessed therefrom, the hanging member includes a block disposed at the inner surface thereof corresponding to the latching slot of the body; the block latches into the latching slot.

* * * * *